US007186157B2

(12) United States Patent
Mansson et al.

(10) Patent No.: US 7,186,157 B2
(45) Date of Patent: Mar. 6, 2007

(54) TURNING PROPELLER DRIVE FOR A BOAT

(75) Inventors: Staffan Mansson, Myggenas (SE); Oddbjorn Hallenstvedt, Valskog (SE)

(73) Assignee: AB Volvo Penta, Göteborg (SE)

( * ) Notice: Subject to any disclaimer, the term of this patent is extended or adjusted under 35 U.S.C. 154(b) by 0 days.

(21) Appl. No.: 11/306,796

(22) Filed: Jan. 11, 2006

(65) Prior Publication Data

US 2006/0199452 A1 Sep. 7, 2006

Related U.S. Application Data

(63) Continuation of application No. PCT/SE04/00627, filed on Apr. 23, 2004, now abandoned.

(30) Foreign Application Priority Data

Jul. 11, 2003 (SE) ..... 0302064

(51) Int. Cl.

| | |
|---|---|
| ***B63H 20/24*** | (2006.01) |
| ***B63H 5/125*** | (2006.01) |
| ***B63H 20/12*** | (2006.01) |
| ***B63H 20/16*** | (2006.01) |
| ***B63H 25/42*** | (2006.01) |

(52) U.S. Cl. ..... 440/89 R; 440/89 A; 440/53; 440/112

(58) Field of Classification Search ..... 440/49, 440/51, 53, 79–83, 88 R, 89 R, 89 A, 89 G, 440/89 J, 111, 112; 416/93 A
See application file for complete search history.

(56) References Cited

U.S. PATENT DOCUMENTS 3,919,965 A * 11/1975 Ross ..... 440/53
4,911,666 A * 3/1990 Gage et al. ..... 440/89 R
5,224,888 A * 7/1993 Fujimoto et al. ..... 440/61 R
5,514,013 A 5/1996 Rodskier
6,508,681 B1 1/2003 Neisen
6,599,159 B1 * 7/2003 Hedlund et al. ..... 440/81

(Continued)

*Primary Examiner*—Ajay Vasudeva
(74) *Attorney, Agent, or Firm*—Novak Druce & Quigg, LLP

(57) ABSTRACT

A rotatable propeller drive (1) for a boat, where the propeller drive (1) includes an upper fixing plate (4) adapted for rotationally fixed attachment to the hull bottom (2) of the boat. A lower underwater housing (6) is provided on which at least one propeller (10, 10*a*, 10*b*) is mounted, which underwater housing (6) is mounted rotatably in the fixing plate (4) about an essentially vertical axis of rotation (8). An exhaust duct (50) is provided with an exhaust exit (14) located in the underwater housing (6). The exhaust duct (50) has an upper duct section (54) which extends through the fixing plate (4) and has an outlet opening (62) located in proximity to an opposite inlet opening (60) in a lower duct section (56) which extends through the underwater housing (6). One of the outlet opening (62) and inlet opening (60) overlaps the other at least within a limited first rotation angle range for the propeller drive (1). A sliding seal arrangement (58) is adapted for sealing between the upper (54) and lower (56) duct sections, where the sliding seal arrangement (58) includes a sealing element (64) accommodated in a seat (66) around one of the outlet opening (62) and inlet opening (60). The sealing element (64) has a contact surface (68) for sliding contact with an opposite sliding seal surface (70) around the other of the outlet opening (62) and inlet opening (60).

19 Claims, 6 Drawing Sheets

U.S. PATENT DOCUMENTS 6,623,320 B1 * 9/2003 Hedlund ..... 440/80
6,705,907 B1 * 3/2004 Hedlund ..... 440/51
6,783,410 B2 * 8/2004 Florander et al. ..... 440/51

* cited by examiner

TURNING PROPELLER DRIVE FOR A BOAT

CROSS-REFERENCE TO RELATED APPLICATIONS

The present application is a continuation patent application of International Application No. PCT/SE2004/000627 filed 23 Apr. 2004 now abandoned which is published in English pursuant to Article 21(2) of the Patent Cooperation Treaty, and which claims priority to Swedish Application No. 0302064-1 filed 11 Jul. 2003. Said applications are expressly incorporated herein by reference in their entireties.

TECHNICAL FIELD OF THE INVENTION

The present invention relates to a rotatable propeller drive for a boat. The propeller drive is provided with an exhaust duct for discharging exhaust gases from an internal combustion engine connected to the propeller drive. The propeller drive has an upper fixing plate for rotationally fixed attachment to the hull bottom of the boat, and a lower underwater housing on which at least one propeller is mounted. The underwater housing is mounted rotatably in the fixing plate, and the invention concerns in particular sealing between an upper duct section of the exhaust duct arranged in the fixing plate and a lower duct section of the exhaust duct arranged in the underwater housing, where the lower duct section is displaced in relation to the upper duct section when the propeller drive is rotated.

BACKGROUND OF INVENTION

In propeller drives where an exhaust duct is divided into two duct sections as indicated above, a seal is required between the two duct sections in order to avoid exhaust gas leakage when the boat is driven, at least above a certain minimum speed. This minimum speed may be, for example, 3–5 knots and can also be said to correspond to a practical upper limit for driving the boat in a harbor area or in proximity to another mooring. If exhaust gases are allowed to leak out between the duct sections when the boat is driven above said minimum speed, exhaust gases may be drawn into the boat at the stern where a local negative pressure then prevails. This effect is sometimes called the wagon-back effect. An undesirable exhaust gas discharge between the duct sections when the boat is driven at a speed exceeding said minimum speed also leads to unfavorable hydrodynamic flow conditions arising in the transition region between the fixing plate and the underwater housing, which has a negative effect on the propulsion of the boat.

An obvious and generally well-known way of sealing exhaust ducts which are movable relative to one another is to arrange a sealing flexible exhaust bellows made of rubber or rubber-like material between the duct sections. A problem with such a solution in this case, however, is that the exhaust bellows is relatively bulky in the vertical direction, in particular when it has to cover a certain rotation range for the propeller drive.

SUMMARY OF INVENTION

The drawbacks described above are solved by virtue of the present invention's provision of a specially adaptation for a rotatable propeller drive of a boat. The propeller drive comprises (includes, but is not necessarily limited to) an upper fixing plate adapted for rotationally fixed attachment to the hull bottom of the boat. A lower underwater housing is provided and upon which at least one propeller is mounted and the housing is mounted rotatably in the fixing plate about an essentially vertical axis of rotation. An exhaust duct is provided with an exhaust exit located in the underwater housing.

The invention is characterized in particular in that the exhaust duct has an upper duct section which extends through the fixing plate and has an outlet opening located in proximity to an opposite inlet opening in a lower duct section which extends through the underwater housing. One of the outlet opening and inlet opening overlaps the other at least within a limited first rotation angle range for the propeller drive. Further, a sliding seal arrangement is provided that is adapted for sealing between the upper and lower duct sections, and in which the sliding seal arrangement comprises a sealing element accommodated in a seat around one of the outlet opening and inlet opening. The sealing element has a contact surface for sliding contact with an opposite sliding seal surface around the other of the outlet opening and inlet opening.

In one advantageous embodiment of the invention, the sliding seal surface is designed on a separate wear plate which is attached firmly either around the outlet opening in the upper duct section or around the inlet opening in the lower duct section and is provided with an opening which essentially coincides with that of said inlet opening or outlet opening around which the wear plate is attached.

In an embodiment which functions well, the sealing element is at least partly elastically deformable and has a radially inwardly facing side edge which is adapted so as, under the influence of an exhaust gas pressure in the exhaust duct, to be displaced radially outwardly fully or partly, while a radially outwardly facing side edge on the sealing element is adapted to bear against a fixed radially inwardly facing stay edge, the sealing element being adapted so as, by elastic deformation, to expand vertically in the direction of the sliding seal surface, as a result of which an increased sealing pressure against the sliding seal surface is obtained at increased exhaust gas pressure.

In a favorable embodiment of the invention, an inner sealing lip is designed in proximity to said radially inwardly facing side edge of the sealing element, which sealing lip bears against the seat in such a way that a hollow channel extending all around is defined radially outside said sealing lip between that edge of the sealing element facing the seat and the seat.

In one embodiment, the sealing element is divided into a lower elastically deformable part and an essentially rigid upper part, where the contact surface of the sealing element is located on the rigid part.

The elastically deformable part is suitably made wholly or partly from a rubber material or a material with rubber-like properties, while the rigid part is made wholly or partly from stainless steel or plastic.

The rigid part of the sealing element is preferably designed as a dimensionally stable frame with a U-shaped cross section, which frame partly accommodates the elastically deformable part of the sealing element.

In one embodiment, the radially inwardly facing stay edge mentioned above consists of an outer leg portion of the frame, while the radially outwardly facing side edge on the sealing element is defined on the elastically deformable part.

In an alternative embodiment, the radially inwardly facing stay edge consists of an outer delimiting edge for the seat.

In one embodiment, the rigid part constitutes a separate part in relation to the elastically deformable part.

In an alternative embodiment, the rigid part is attached to the elastically deformable part, for example by vulcanization.

In an advantageous embodiment, the wear plate is, at least at the sliding seal surface, made from a hard wearing low-friction material, such as, for example, polytetrafluoroethylene (PTFE).

The limited first rotation angle range preferably corresponds to a rotation of the propeller drive of between 10 and 15 degrees to starboard and port, respectively.

In a preferred embodiment, the propeller drive is adapted for at least one tractor propeller. A twin-propeller combination of a fore propeller and an aft propeller is especially advantageous.

The upper and lower duct sections of the exhaust duct are preferably located astern of the axis of rotation of the propeller drive.

BRIEF DESCRIPTION OF THE DRAWINGS

The invention will be described in detail below with reference to accompanying drawings, in which.

DETAILED DESCRIPTION

Figure 1:
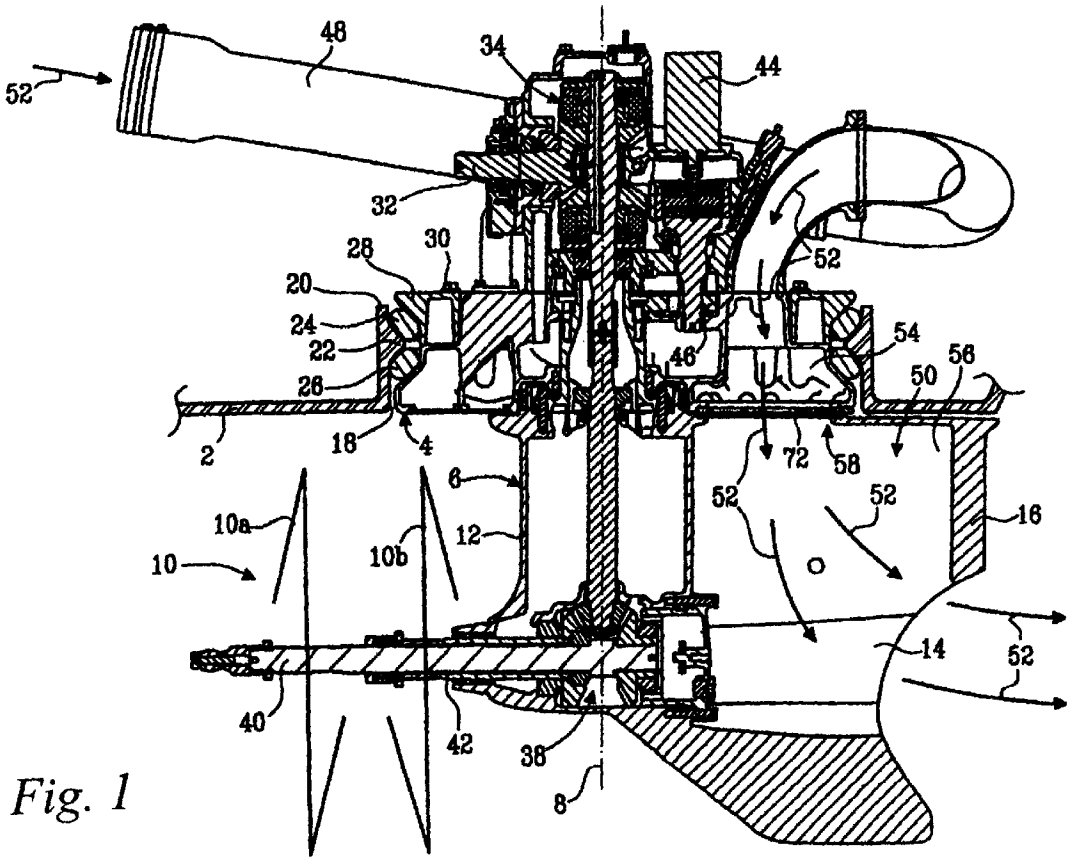
FIG. 1 shows a longitudinal cross-sectional view of a rotatable propeller drive configured according to an exemplary embodiment of the invention.

In FIG. 1, reference number 1 designates generally a rotatable propeller drive according to an exemplary embodiment of the invention. The propeller drive 1 is attached to the hull bottom 2 on a boat (not shown) and comprises an upper fixing plate 4 adapted for rotationally fixed attachment to the hull bottom 2 of the boat. A lower underwater housing 6 is mounted rotatably in the fixing plate 4 about an essentially vertical axis of rotation 8.

A tractor propeller 10 is arranged on the underwater housing 6. Here, to be precise, the propeller consists of a twin propeller combination of a fore propeller 10*a* and an aft propeller 10*b* rotating in the opposite direction, both of which are illustrated diagrammatically in FIG. 1 and located on the fore side 12 of the underwater housing 6. One advantage of tractor instead of pusher propellers on a propeller drive 1 of this type is that the propellers 10*a*, 10*b* work in undisturbed water, as the underwater housing 6 lies behind the propellers 10*a*, 10*b*. This also creates space for an exhaust exit 14 in the aft side 16 of the underwater housing 6 which means that it is possible to utilize the ejector effect exerted on the outflowing exhaust gases by the water flowing past, resulting in reduced exhaust gas back-pressure. Furthermore, as the exhaust gases are conducted out at the aft side 16 of the underwater housing 6 instead of through the hub (not shown), the hub diameter can be reduced, which is advantageous in several respects. On the one hand, the mass and the mass forces are reduced, and, on the other hand, the space requirement under the hull bottom 2 is reduced. This means that the underwater housing 6 can be designed to be shorter in the vertical direction and consequently lighter than if pusher propellers with an exhaust exit in the hub were used. The propeller drive 1 is advantageously positioned in close proximity to the stern 3 of the boat.

In an exemplary embodiment, the fore propeller 10*a* is three-bladed (not shown in FIG. 1), while the aft propeller 10*b* is four-bladed. The aft propeller 10*b* therefore has one blade more than the fore propeller 10*a*, which is known per se in rotatable propeller drives. In a preferred embodiment, the blade areas (not shown) of the propellers 10*a*, 10*b* are moreover adapted to one another in such a way that the aft propeller 10*b* works in a cavitating way within a predetermined upper speed range, while the fore propeller 10*a* works in a non-cavitating way.

The boat (not shown) can be equipped with a single propeller drive 1, or alternatively with a number of propeller drives 1, normally in a twinned mounting (not shown) arrangement in which two propeller drives 1 are mounted next to one another in order to achieve increased maneuverability.

As can also be seen from FIG. 1, the hull bottom 2 is designed with an opening 18, which is surrounded by a vertical shaft 20, which projects up into the hull bottom 2. The shaft 20 is preferably cast in one piece with the hull bottom 2 and is designed with an inwardly directed peripheral flange 22, which has an essentially triangular cross section in the illustrative embodiment shown. The shaft 20 with the flange 22 forms the mounting arrangement for the fixing plate 4 of the propeller drive 1, which grips around the flange 22 via a pair of intermediate vibration-damping and sealing elastic rings 24 and 26. An upper locking ring 28 is adapted to be fixed to the fixing plate 4 by means of, for example, bolts 30 (of which only the bolt heads are shown partly in FIG. 1) when the propeller drive 1 is mounted.

An internal combustion engine (not shown) drives—via an input shaft 32 in a reversing gear mechanism 34—a vertical drive shaft 36, which, in the illustrative embodiment shown, coincides with the geometrical axis of rotation 8 (illustrated by dot/dash line), referred to in the introduction, of the propeller drive 1. Via a bevel gear 38, the vertical drive shaft 36 is coupled to two horizontal and concentric propeller shafts 40, 42, of which the propeller shaft 42 is a hollow shaft through which the propeller shaft 40 extends. In this connection, the propeller shaft 40 drives the fore propeller 10*a*, while the propeller shaft 42 drives the aft propeller 10*b*.

The rotation of the underwater housing 6 of the propeller drive 1 is brought about by a servomotor 44 via a gear rim 46 connected to the underwater housing 6.

An exhaust pipe 48 extends from the internal combustion engine (not shown) and on through an exhaust duct 50 in the propeller drive 1 to the exhaust exit 14 in the aft side 16 of the underwater housing 6. In FIG. 1, the exhaust flow is illustrated by means of the arrows 52. The exhaust duct 50 has an upper duct section 54 which extends through the fixing plate 4, and a lower duct section 56 which extends through the underwater housing 6 and at the bottom, on a level with the propeller shafts 40 and 42, runs into the exhaust exit 14. The upper and lower duct sections 54 and 56 of the exhaust duct are located astern of the axis of rotation 8 of the propeller drive 1 in the embodiment shown.

Figure 2:
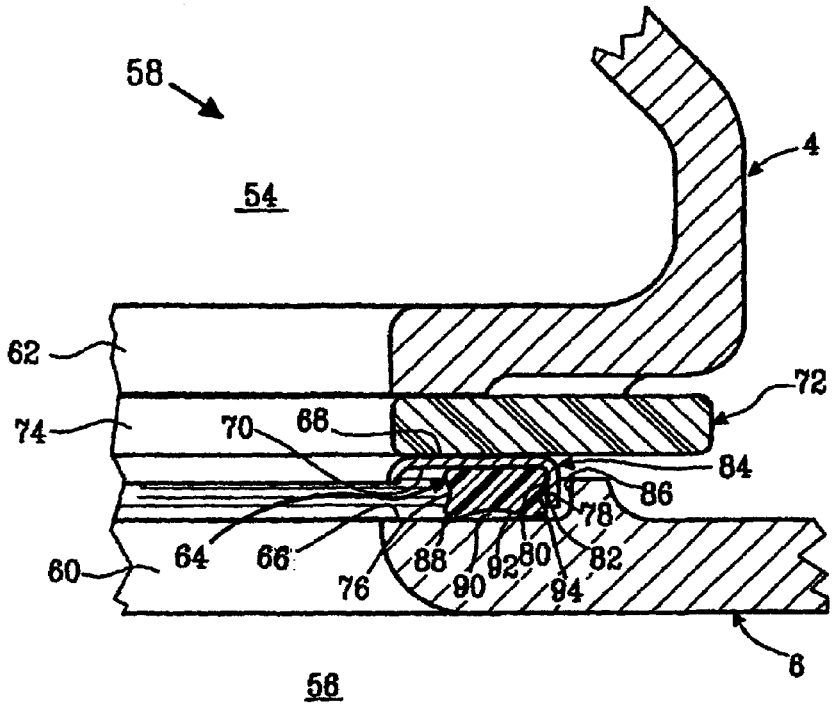
FIG. 2 shows an enlarged part-section of the sliding seal arrangement according to the embodiment shown in FIG. 1.

According to the invention, a sliding seal arrangement 58 is adapted for sealing between said upper and lower duct sections 54 and 56. For the sake of clarity, an enlarged part-section through the sliding seal arrangement 58 is shown in FIG. 2 which can advantageously be looked at during the following description of the construction of the sliding seal arrangement 58.

The sliding seal arrangement 58 comprises an inlet opening 60 designed in the lower duct section 56, which inlet opening 60 overlaps an opposite outlet opening 62 in the upper duct section 54 at least within a limited first rotation angle range for the propeller drive 1. A sealing element 64 extending all around is accommodated in a seat 66 around the inlet opening 60 in the lower duct section 56. The sealing element 64 has an upper contact surface 68 for contact with an opposite, downwardly directed sliding seal surface 70 around the outlet opening 62 in the upper duct section 54. As can be seen clearly from FIG. 2, the downwardly directed sliding seal surface 70 is, in the embodiment shown, designed on a separate wear plate 72, which is attached firmly to the fixing plate 4 around the outlet opening 62 in the upper duct section 54 by means of screws (not shown) or other suitable fixing elements. The wear plate 72 is arranged exchangeably, in order for it to be possible if required to replace a worn wear plate with a new wear plate. The wear plate 72 is also provided with an opening 74 which essentially coincides with the outlet opening 62. The wear plate 72 is, at least at the downwardly directed sliding seal surface 70, made from a hard-wearing low-friction material, such as, for example, polytetrafluoroethylene (PTFE).

The sealing element 64 is designed to be at least partly elastically deformable and has a radially inwardly facing side edge 76. Under the influence of an exhaust gas pressure in the exhaust duct 50, the inwardly facing side edge 76 is displaced radially outward; that is to say, to the right in FIG. 2, while a radially outwardly facing side edge 78 on the sealing element 64 bears against a fixed, radially inwardly facing stay edge 80. The elastically deformable sealing element 64 is therefore compressed in the radially outward direction under the influence of the exhaust gas pressure, which results in it expanding vertically in the direction of the downwardly directed sliding seal surface 70 on the wear plate 72, as a result of which an increased sealing pressure against the sliding seal surface 70 is obtained at increased exhaust gas pressure.

In the illustrative embodiment shown, the fixed stay edge 80 is designed in an outer leg portion 82 of a dimensionally stable frame 84 with a downwardly directed, essentially rectangular U-shaped cross section. The frame 84 and its function will be described in greater detail later in this description.

By way of definition, the sealing element 64 can be said to be divided into a lower elastically deformable part and a rigid upper part. Here, the lower elastically deformable part is made wholly or partly from a rubber material or a material with rubber-like properties, while the rigid upper part, in the embodiment shown, consists of the U-shaped frame 84 described above. The frame 84 can suitably be made wholly or partly from stainless steel or plastic, but other materials suitable for the purpose can also be used.

The upper contact surface 68 of the sealing element 64 in contact with the downwardly directed sliding seal surface 70 on the wear plate 72 is, with such a definition, located on the rigid upper part; that is to say, on the frame 84. As can also be seen from FIG. 2, the frame 84 is, owing to its U shape, designed in such a way that it partly accommodates the lower, elastically deformable part of the sealing element 64. In this connection, the radially outwardly facing side edge 78 on the sealing element 64 is defined on the lower, elastically deformable part and is therefore adapted for contact with the fixed stay edge 80 in the outer leg portion 82 of the frame 84.

According to the invention, the frame 84 can either constitute a separate part in relation to the lower elastically deformable part of the sealing element 64, or the frame 84 can be attached to the lower elastically deformable part, for example by vulcanization. In the latter case, the stay edge 80 consists instead of an outer delimiting edge 86 for the seat 66 around the inlet opening 60 in the lower duct section 56. The outer delimiting edge 86 also serves as a positioning aid when the sealing element 64 is placed in the seat 66 in connection with mounting of the propeller drive 1.

As can also be seen from FIG. 2, an inner sealing lip 88 is designed in proximity to the radially inwardly facing side edge 76 of the sealing element 64. The sealing lip 88 bears downwardly against the seat 66 in such a way that a hollow channel 90 extending all around is defined radially outside the sealing lip 88 between that edge 92 of the sealing element 64 facing the seat 66 and the seat 66. It can also be seen in the figure that that edge of the sealing element 64 facing the seat 66, its inwardly facing side edge 76 and its outwardly facing side edge 78 are all of clearly concave design in the embodiment shown. The concave design results in the inner sealing lip 88 and also a corresponding outer sealing lip 94 which also bears against the seat 66.

Figure 3:
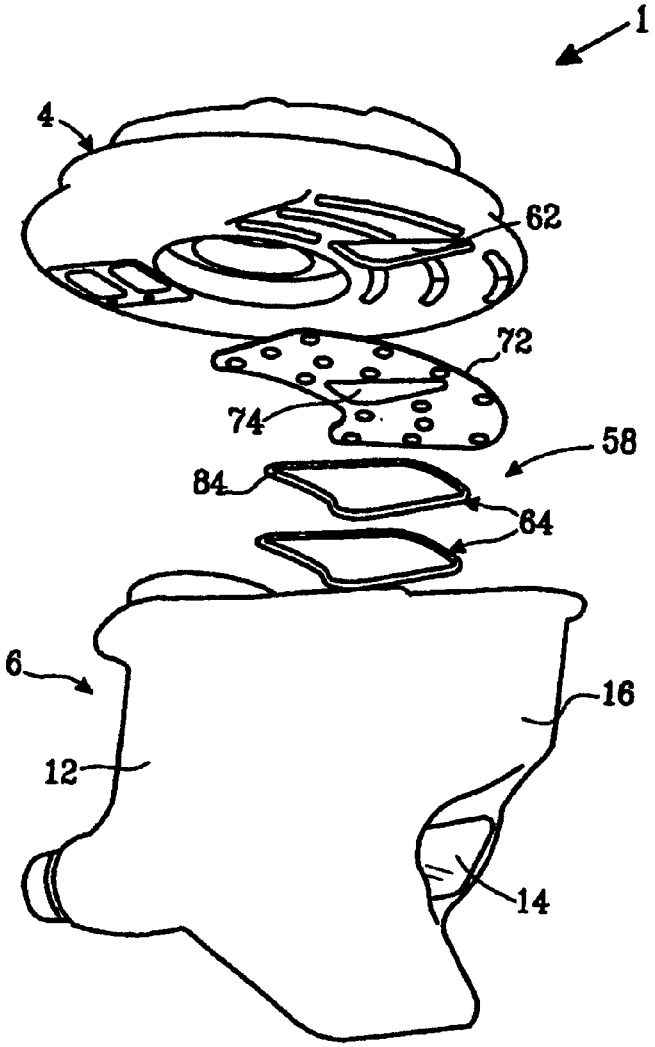
FIG. 3 shows an exploded view, in perspective at an angle from below of a propeller drive, according to the embodiment in FIG. 1, where, however, the propeller is not shown.
Figure 4:
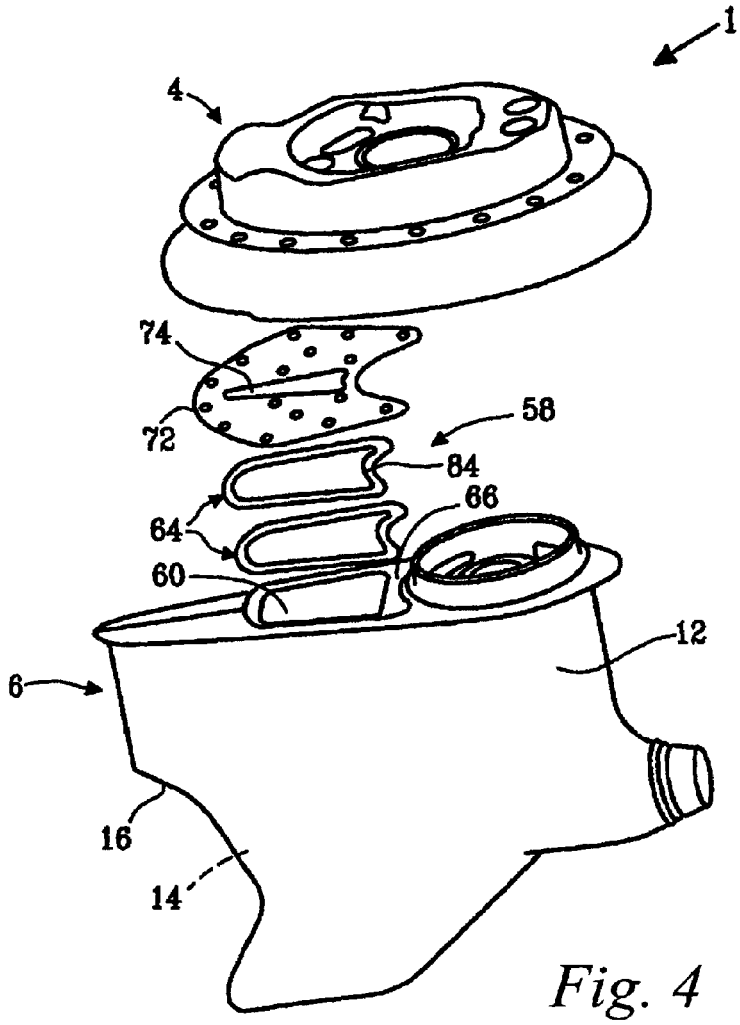
FIG. 4 shows an exploded view in perspective at an angle from above of a propeller drive according to the embodiment in FIG. 1 (although the propeller is not shown)
Figure 5:
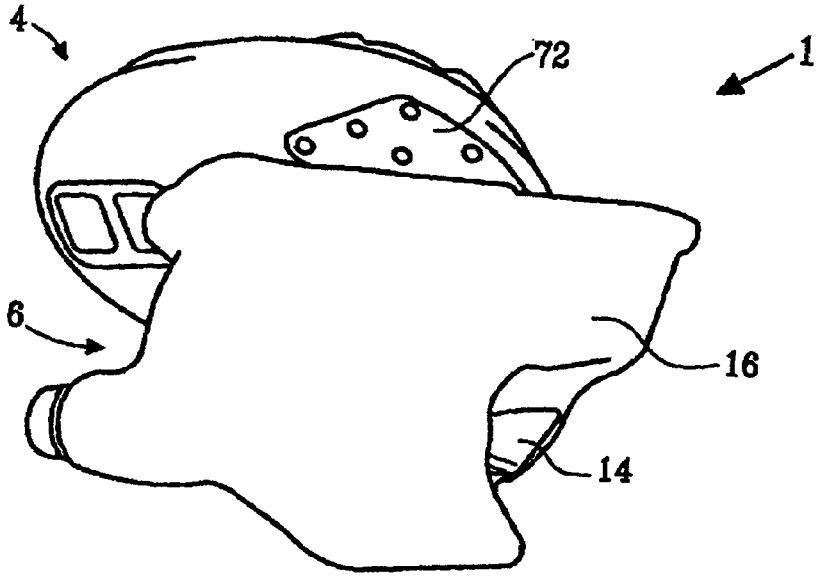
FIG. 5 shows a perspective view at an angle from below of the assembled propeller drive (although the propeller is not shown)

FIGS. 3 and 4 show exploded views of the propeller drive 1 in perspective. In the illustrative embodiment shown, the frame 84 constitutes a separate rigid part (on top in FIGS. 3 and 4) in relation to the lower elastically deformable part of the sealing element 64. The shape of the sealing element 64, the wear plate 72 and the opening 74 in the wear plate can also be seen from the figures. These shapes will be described in greater detail below with reference to FIG. 6. FIG. 5 shows the propeller drive at an angle from below in assembled state.

Figure 6:
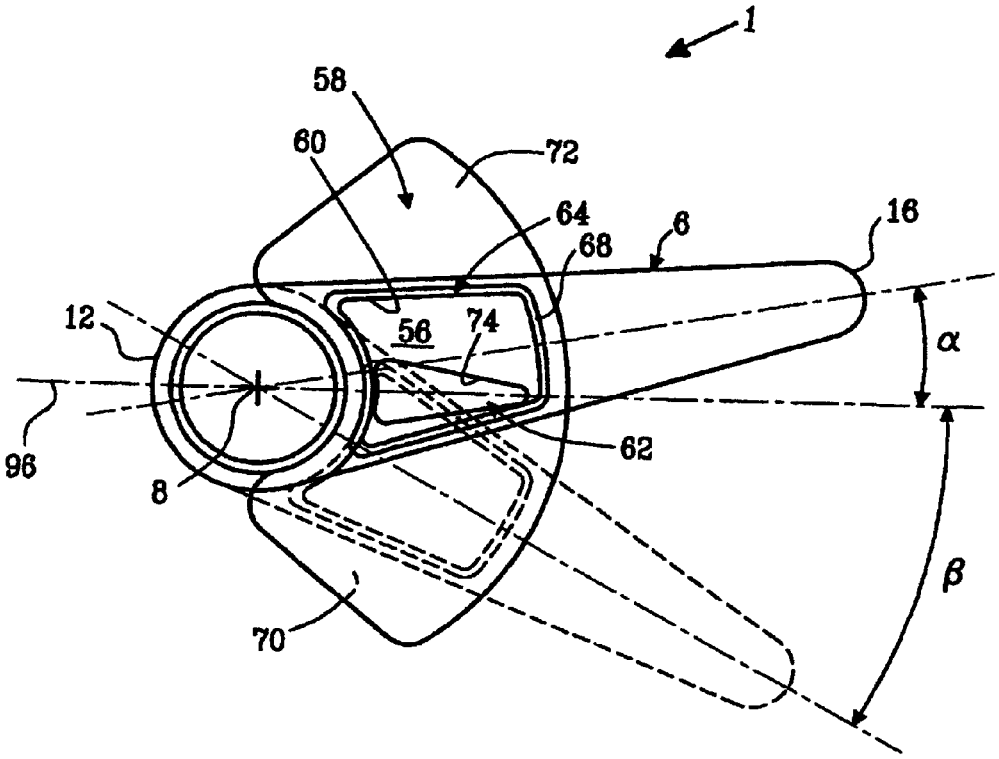
FIG. 6 shows a diagrammatic illustration of relative positions of the inlet opening of the lower duct section and the outlet opening of the upper duct section at different rotation angles of the underwater housing.

FIG. 6 shows a diagrammatic illustration of relative positions of the inlet opening 60 of the lower duct section 56 and the outlet opening 62 of the upper duct section 54 at different rotation angles of the underwater housing 6. The propellers 10*a*, 10*b* are not shown in this schematic view, but they project, as described above, further down on the fore side 12 of the underwater housing 6, on the left side of the figure. According to the embodiment shown, the inlet opening 60 in the lower duct section 56 is adapted to overlap the opposite outlet opening 62 in the upper duct section 54 fully only within a limited first rotation angle range around a center position for the propeller drive 1; more precisely, the underwater housing 6. The center position is illustrated in the figure by the horizontal dot-dash line 96. This is illustrated in the figure by the underwater housing 6 in the representation in solid lines being shown rotated by a first angle $\alpha$ of roughly 10° to starboard (upward in FIG. 6). At this rotation, the inlet opening in the lower duct section 56 therefore overlaps fully the opposite outlet opening 62 in the upper duct section 54.

In a suitable embodiment, the limited first rotation angle range corresponds to a rotation of the propeller drive 1; to be precise, of the underwater housing 6 of between 10 and 15 degrees to starboard and port, respectively. Full overlapping therefore takes place only within this limited first rotation angle range around the center position 96, which range easily covers typical maneuvers at normal cruising speed or speeds above this.

When rotation beyond the limited first rotation angle range takes place, however, the exhaust gases are blown in full or in part directly out of the outlet opening 62 of the upper duct section 54, as is shown by the representation in dashed lines of the underwater housing 6. Here, the underwater housing 6 is shown rotated to port (downward in the figure) by an angle β corresponding to roughly 30 degrees, which results in the inlet opening 60 in the lower duct section 56 being rotated in part past the opposite outlet opening 62 in the upper duct section 54. The exhaust gases are then discharged in part at the side of the inlet opening 60 in the lower duct section 56 on a level with the sealing device 64 directly below the hull bottom 2. This is acceptable at lower speeds—up to roughly 5 knots—for example when maneuvering in a harbor where large rotation angles may be required. This is because at these low speeds the same advantages of the exhaust gases being discharged on a level with the propeller shafts 40, 42, which therefore takes place at higher speeds and with a smaller rotation angle, are not achieved.

FIG. 6 also shows that the wear plate 72 is designed as part of a sector of a circle around the axis of rotation 8 and thus has an essentially fan-like shape. The wear plate 72 extends to the sides to such an extent that the downwardly facing sliding seal surface of the wear plate 72 makes contact of the entire upper contact surface 68 on the sealing element 64 possible throughout the rotation angle range of the propeller drive 1, which is 30 degrees to each side in the embodiment shown.

The outlet opening 62 in the upper duct section 54, like the opening 74 in the wear plate 72, has an essentially oblong triangular shape with the base facing the axis of rotation 8 and the top facing astern. As can also be seen from FIG. 6, the inlet opening 60 in the lower duct section 56 is essentially of rounded rectangular design and is considerably larger than the outlet opening 62 in the upper duct section 54 so as to be capable of overlapping the same during rotation within said limited first rotation angle range.

The invention is not limited to the illustrative embodiments described above and shown in the accompanying drawings, but can be varied freely within the scope of the patent claims. For example, the design of the sliding seal arrangement 58 can be reversed compared with the embodiment shown in the figures. In such a reversed or inverted sliding seal arrangement 58, some of the references above to "upper" and "lower" consequently no longer apply, as the wear plate 72 is then instead attached firmly around the inlet opening 60 in the lower duct section 56, while the seat 66 is arranged around the outlet opening 62 in the upper duct section 54. The orientation of the sealing element 64 also is then reversed so that the frame 84 faces downward instead for contact with the wear plate 72. Here, the opening 74 in the wear plate 72 coincides instead with the inlet opening 62 in the lower duct section 56. To facilitate assembly in such a reversed embodiment, holder means (not shown) can be designed at the seat 66 or in the sealing element 64 for retaining the sealing element 64 during mounting of the underwater housing 6.

Furthermore, the frame 84 can be designed with a different cross-sectional shape, such as an L shape. Although the embodiment of the propeller drive 1 shown is intended for tractor propellers, the sliding seal arrangement can also be applied to a correspondingly designed propeller drive for pusher propellers (not shown). It is also conceivable, within the scope of the invention, for the rigid part and the elastically deformable part of the sealing element 64 to be produced by a process in which a common, originally homogeneous starting material is given locally different mechanical properties.

LIST OF REFERENCE DESIGNATIONS

1 propeller drive
2 hull bottom
3 stern
4 fixing plate
6 underwater housing
8 axis of rotation
10 propeller, in general
10*a* fore propeller
10*b* aft propeller
12 fore side of underwater housing
14 exhaust exit
16 aft side of underwater housing
18 opening in hull bottom
22 peripheral flange
24 elastic ring
26 elastic ring
28 locking ring for fixing plate
30 bolts for locking ring
32 input shaft in reversing gear mechanism
34 reversing gear mechanism
36 vertical drive shaft
38 bevel gear in underwater housing
40 propeller shaft for fore propeller
42 propeller shaft for aft propeller
44 servomotor
46 gear rim
48 exhaust pipe
50 exhaust duct
52 arrows, illustrating exhaust flow
54 upper duct section
56 lower duct section
58 sliding seal arrangement
60 inlet opening in lower duct section
62 outlet opening in upper duct section
64 sealing element
66 seat
68 contact surface
70 sliding seal surface
72 wear plate
74 opening in wear plate
76 inwardly facing side edge on sealing element
78 outwardly facing side edge on sealing element
80 stay edge
82 leg portion of frame
84 frame
86 outer delimiting edge for seat
88 inner sealing lip
90 hollow channel
92 edge on the sealing element facing the seat
94 outer sealing lip
96 center position
α rotation angle from center position in a first predetermined rotation angle range
β rotation angle from center position beyond first rotation angle range

What is claimed is:

1. A rotatable propeller drive (1) for a boat in which said propeller drive (1) comprises:

an upper fixing plate (4) adapted for rotationally fixed attachment to the hull bottom (2) of a boat and a lower underwater housing (6) on which at least one propeller (10, 10*a*, 10*b*) is mounted, said underwater housing (6) being rotatably mounted at the fixing plate (4) about an essentially vertical axis of rotation (8);

an exhaust duct (50) provided with an exhaust exit (14) located in the underwater housing (6), wherein the exhaust duct (50) includes: an upper duct section (54) which extends through the fixing plate (4) and has an outlet opening (62) located in proximity to an opposite inlet opening (60) in a lower duct section (56) which extends through the underwater housing (6), where one of said outlet opening (62) and said inlet opening (60) overlaps the other at least within a limited first rotation angle range for the propeller drive (1), and wherein said outlet and inlet openings (62, 60) are offset from said vertical axis of rotation (8); and said exhaust duct (50) further comprises a sliding seal arrangement (58) adapted for sealing between said upper duct section (54) and said lower duct section (56), wherein said sliding seal arrangement (58) comprises a sealing element (64) accommodated in a seat (66) around one of said outlet opening (62) and said inlet opening (60), which sealing element (64) has a contact surface (68) slidingly contacting an opposite sliding seal surface (70) around the other of said outlet and inlet openings (62, 60).

2. The rotatable propeller drive as recited in claim 1, wherein said sliding seal surface (70) is provided on a separate wear plate (72) attached firmly around one of (i) the outlet opening (62) in the upper duct section (54) and (ii) the inlet opening (60) in the lower duct section (56) and is provided with an opening (74) that essentially coincides with said inlet opening (60) or outlet opening (62) around which the wear plate (72) is attached.

3. The rotatable propeller drive as recited in claim 2, wherein said sealing element (64) is at least partly elastically deformable and has a radially inwardly facing side edge (76) which is adapted so as, under the influence of an exhaust gas pressure in the exhaust duct (50), to be displaced radially outwardly fully or partly, while a radially outwardly facing side edge (78) on the sealing element (64) is adapted to bear against a fixed radially inwardly facing stay edge (80), the sealing element (64) being adapted so as, by elastic deformation, to expand vertically in the direction of the sliding seal surface (70), as a result of which an increased sealing pressure against the sliding seal surface (70) is obtained at increased exhaust gas pressure.

4. The rotatable propeller drive as recited in claim 1, wherein said sealing element (64) is at least partly elastically deformable and has a radially inwardly facing side edge (76) which is adapted so as, under the influence of an exhaust gas pressure in the exhaust duct (50), to be displaced radially outwardly fully or partly, while a radially outwardly facing side edge (78) on the sealing element (64) is adapted to bear against a fixed radially inwardly facing stay edge (80), the sealing element (64) being adapted so as, by elastic deformation, to expand vertically in the direction of the sliding seal surface (70), as a result of which an increased sealing pressure against the sliding seal surface (70) is obtained at increased exhaust gas pressure.

5. The rotatable propeller drive as recited in claim 4, wherein said radially inwardly facing stay edge (80) consists of an outer leg portion (82) of the frame (84), while the radially outwardly facing side edge (76) on the sealing element (64) is defined on the elastically deformable part.

6. The rotatable propeller drive as recited in claim 1, further comprising:

an inner sealing lip (88) is designed in proximity to a radially inwardly facing side edge (76) of the sealing element (64), which sealing lip (88) bears against the seat (66) in such a way that a hollow channel (90) extending all around is defined radially outside said sealing lip (88) between that edge (92) of the sealing element (64) facing the seat (66) and the seat (66).

7. The rotatable propeller drive as recited in claim 1, wherein said sealing element (64) is divided into an elastically deformable part and an essentially rigid part, where the contact surface (68) of the sealing element (64) is located on the rigid part.

8. The rotatable propeller drive as recited in claim 7, wherein said elastically deformable part is made wholly or partly from a rubber material or a material with rubber-like properties, while the rigid part is made wholly or partly from stainless steel or plastic.

9. The rotatable propeller drive as recited in claim 8, wherein said rigid part of the sealing element (64) is designed as a dimensionally stable frame (84) with a U-shaped cross section, which frame (84) partly accommodates the elastically deformable part of the sealing element (64).

10. The rotatable propeller drive as recited in claim 7, wherein said rigid part of the sealing element (64) is designed as a dimensionally stable frame (84) with a U-shaped cross section, which frame (84) partly accommodates the elastically deformable part of the sealing element (64).

11. The rotatable propeller drive as recited in claim 10, wherein a radially inwardly facing stay edge (80) on the sealing element (64) consists of an outer leg portion (82) of the frame (84), while a radially outwardly facing side edge (76) on the sealing element (64) is defined on the elastically deformable part.

12. The rotatable propeller drive as recited in claim 7, wherein said rigid part constitutes a separate part in relation to the elastically deformable part.

13. The rotatable propeller drive as recited in claim 7, wherein said rigid part is attached to the elastically deformable part.

14. The rotatable propeller drive as recited in claim 1, wherein a radially inwardly facing stay edge (80) of the sealing element (64) consists of an outer delimiting edge (86) for the seat (66).

15. The rotatable propeller drive as recited in claim 1, wherein said sliding seal surface (70) is provided on a wear plate (72), wherein said wear plate (72) is, at least at the sliding seal surface (70), made from a hard-wearing, low-friction material.

16. The rotatable propeller drive as recited in claim 1, wherein said limited first rotation angle range corresponds to a rotation of the propeller drive (1) of between 10 and 15° to starboard and port respectively.

17. The rotatable propeller drive as recited in claim 1, wherein said propeller drive (1) is adapted for at least one tractor propeller (10, 10*a*, 10*b*).

18. The rotatable propeller drive as recited in claim 17, wherein said upper (54) and lower (56) duct sections of the exhaust duct (50) are located astern of the axis of rotation (8) of the propeller drive (1).

19. The rotatable propeller drive as recited in claim 1, wherein said propeller drive (1) is adapted for a twin propeller combination of a fore propeller (10*a*) and an aft propeller (10*b*).

* * * * *